US006727810B1

(12) United States Patent
Martin et al.

(10) Patent No.: US 6,727,810 B1
(45) Date of Patent: Apr. 27, 2004

(54) METHOD OF DETECTING OBJECTS WITHIN RANGE OF A RECEIVER

(75) Inventors: Brian Martin, Nepean (CA); Jennifer McKenzie, Ottawa (CA)

(73) Assignee: Instantel, Inc., Ottawa (CA)

( * ) Notice: Subject to any disclaimer, the term of this patent is extended or adjusted under 35 U.S.C. 154(b) by 0 days.

(21) Appl. No.: 09/416,534

(22) Filed: Oct. 12, 1999

(51) Int. Cl.[7] ..... G08B 29/00

(52) U.S. Cl. ..... 340/506; 340/505; 340/539.1; 340/539.13; 340/3.1; 340/10.1

(58) Field of Search ..... 340/506, 505, 340/539.1, 539.11, 539.12, 539.13, 539.15, 572.1, 573.4, 3.1, 3.21, 3.41, 3.5, 3.51, 825.2, 10.1, 10.2, 286.07, 572.4, 10.41

(56) References Cited

U.S. PATENT DOCUMENTS 5,686,902 A * 11/1997 Reis et al. ..... 340/825.49 X
5,887,176 A * 3/1999 Griffith et al. ..... 340/825.54 X

* cited by examiner

*Primary Examiner*—Daryl Pope
(74) *Attorney, Agent, or Firm*—Kevin G. Mierzwa

(57) ABSTRACT

A method of detecting a variable number of objects within range of a receiver, is comprised of transmitting from each object a supervisory message from time to time, detecting the supervisory message by the receiver over a detection interval, and varying the detection interval based on a number of objects under supervision and the probability of collisions of the supervisory messages.

20 Claims, 1 Drawing Sheet

METHOD OF DETECTING OBJECTS WITHIN RANGE OF A RECEIVER

FIELD OF THE INVENTION

This invention relates to a method of detection of objects which emit respectively unique supervisory signals that can collide, within range of one or more receivers.

BACKGROUND TO THE INVENTION

It is necessary in some environments to detect the presence of objects which are within certain regions. For example, in a hospital it is necessary to determine general locations of respective professional staff and/or patients; at a convention it may be necessary to locate the general locations of attendees; in a laboratory it may be necessary to locate portable equipment; in a city it may be necessary to locate the general locations of police, or of particular automobiles, the presence and/or location of a person under house arrest may need to be determined, etc.

Various systems exist in which transmitters are attached to the object to be located, e.g. via tags. The transmitters transmit from time to time, which transmissions are received by various receivers. The various receivers detect the transmissions and report the presence of the object within their respective reception ranges. A typical transmission is comprised of an identification (ID) of an object (or of the tag which is attached to the object). If an ID is not received, it is either not within range of the receiver, or if previously detected to be within range, an alarm can be raised.

However, collisions between transmissions from various objects is a problem which results in faulty reception, and which can cause alarms to be raised simply because a collision between properly transmitted ID signals resulted in no reception of some or all of the collided ID signals. For that reason, various schemes have been used to try to avoid the collisions.

For example, in U.S. Pat. No. 5,686,902 a tag location system is described in which the tags respond to interrogation signals. The problem of collisions is addressed using two solutions:

(a) The tag response time is made short relative to the ID collection (listen) time of the receiver. When a tag responds to an interrogation signal, the interrogator transmits directed acknowledgement signals to the tags which shuts off the tags whose Ids have been successfully received by the interrogator (i.e. those whose responses have not collided). This reduces the number of tags left to respond, thus reducing the likelihood of collisions.

(b) The interrogator listen period is a function of the number of tags which respond (i.e. the listen period equals the number of tags multiplied by the response time of a tag after receipt of an interrogation signal). The listen time is therefore reduced when tags whose IDs have been successfully received are shut off, and the number of responding tags thereby reduced.

If the ID of a tag has not been received during the listen time, an alarm is raised.

However, this is not suitable for systems in which the tags must be inexpensive, for example throwaway items. It is also not suitable in which the tags must merely transmit their Ids randomly, without interrogation. The patented system requires each tag to include a radio receiver and logic circuits which can detect an interrogation signal, to enable a response, to detect an addressed acknowledgement signal and to shut off, and to further contain circuits which can wake up the tag receiver to listen to subsequent interrogation signals. This is expensive, and the tags are unlikely to be used in a tag throwaway system.

In U.S. Pat. No. 5,539,394 a system is described in which transmissions from the tags are synchronized, tags emitting signals in predetermined time slots following reception of a "start" signal. The number of tags is in excess of the number of time slots, and therefore collisions are expected to occur. In the case of collisions occurring due to several tags transmitting in the same time slot, a base (hash) number on which the time slots of the colliding tags is based is changed, by downloading. Acknowledgement signals are sent to tags which have already been detected, to cause them to stop transmitting. Therefore as the number of tags is reduced, there will be fewer, or no collisions occurring.

The latter system has similar problems as the former, in that the tag must contain, besides an ID transmitter, a receiver with circuitry to receive the hash number and the acknowledgement signals, to stop transmitting, and to wake up at a particular time. This circuitry is expensive and would be unlikely to be used in a tag throwaway system.

In general the latter system reduces the number of tags transmitting in a fixed listen time.

SUMMARY OF THE INVENTION

In the description herein, the term "tags" will be used synonymously with "objects"; on the basis that if the object itself does not include or consists of transmission circuitry, a tag which does will be attached to a non-transmitting object, converting it to a transmitting object.

The present invention uses tags which preferably randomly transmit supervisory messages which preferably contain the respective IDs of the tags, do not require receivers, and therefore its cost can be reduced.

With the tags transmitting randomly, with no required interrogation or requirement for a shut-off command to be received, a receiver in the present invention can determine the presence of each tag in its reception region by increasing its "listen" interval to a point at which no collisions are detected (to some arbitrary limit). The IDs of the detected tags can be retained in a table (or the IDs of expected tags can be received from another device such as a remote computer) and retained in a table.

In accordance with an embodiment of the present invention, a method of detecting a variable number of objects within range of a receiver comprises:

(a) transmitting from each object a supervisory message from time to time, (b) detecting the supervisory message by the receiver over a detection interval, and (c) varying the detection interval based on a number of objects under supervision and the probability of collisions of the supervisory messages.

In accordance with another embodiment, the variation of the detection interval is undertaken by increasing it to the extent that no collisions of any previously undetected supervisory message occurs.

BRIEF INTRODUCTION TO THE DRAWINGS

A better understanding of the invention may be obtained by reading the detailed description of the invention below, in conjunction with the following drawings, in which.

DETAILED DESCRIPTION OF EMBODIMENTS OF THE INVENTION

Figure 1:
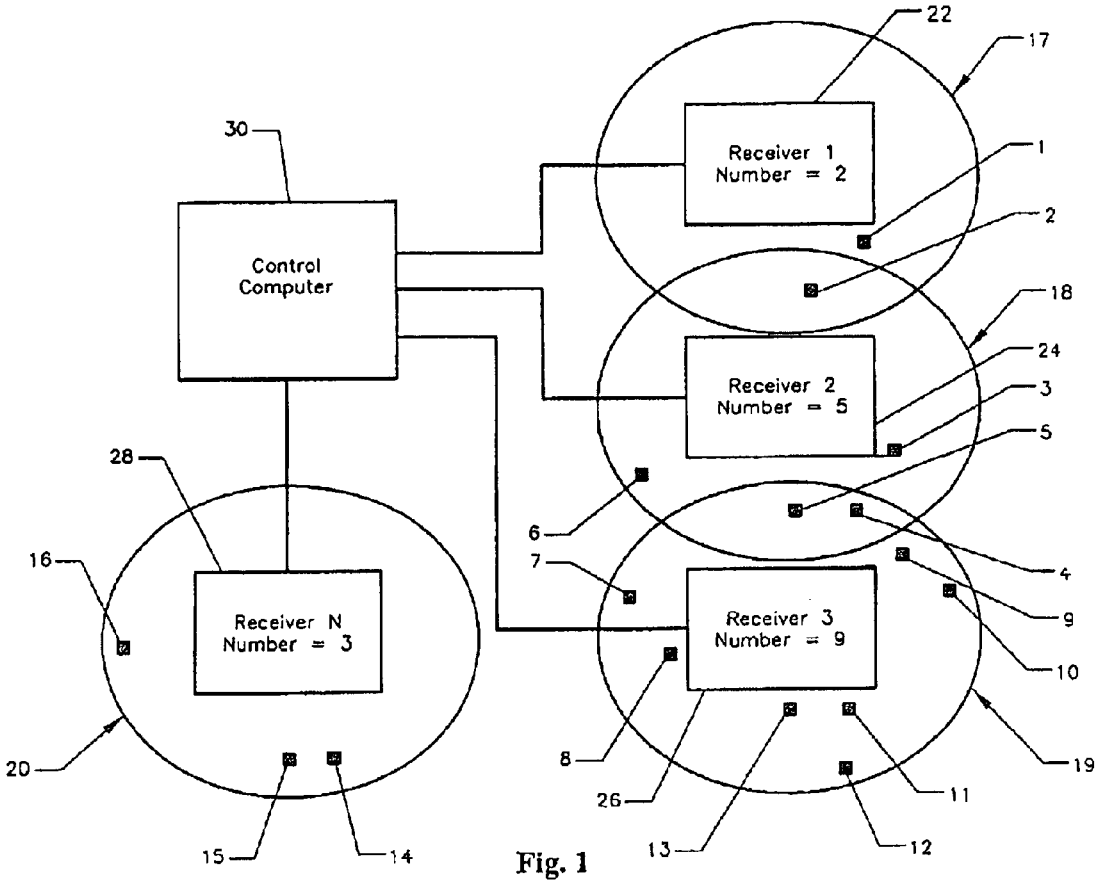
FIG. 1 is a block diagram of an embodiment of the invention.

FIG. 1 illustrates a system which can carry out the invention. Portable transmitters 1–16 are located and can move within the ranges 17–20 of various receivers 22, 24, 26 and 28. As may be seen, some of the tags are within the range of more than one receiver, such as tag 2 being within the ranges of both receivers 22 and 24 and tags 4 and 5 being within the ranges of both receivers 24 and 26.

Each of the tags transmits a supervisory message, which preferably is comprised of an ID. The receivers detect the IDs as they are received, and each receiver can build up a table so that the tags are identified as being within the region of one or more receivers.

Instead of building up a table, a receiver can already have a table which stores either a predetermined restricted list of IDs, or a list of all IDs, against which it can check the received IDs, and mark them as having been received, in the table. The list of IDs can be received from a central source such as a control computer 30 which is in communication with the receivers, or the receivers can send the identities of received IDs to the computer 30 for checking against a master list or against lists of IDs which are expected to relate to tags within the ranges of respective receivers.

With the tags being mobile, and can be enabled or disabled manually or by some other control which is not part of the present invention, the number of tags being supervised by any one receiver changes with time. The more tags being supervised, the higher the likelihood that a supervisory message will not be received by the receiver because the tag transmissions are not synchronized and supervisory messages can collide, sometimes resulting in neither message being correctly received.

In accordance with an embodiment of the present invention, each receiver keeps track of the number or approximate number of tags in its detection area. It does this by either counting the average number of supervisory messages it receives over predetermined time intervals, or by maintaining a table of the unique IDs of tags which have been received, and counting them.

Each receiver then dynamically adjusts its "listen" interval for the tags expected to be in its range based on the number of tags under supervision and the probability of lost supervisory messages caused by collisions.

One way of performing the above is to increase the listen period of the receiver with increasing number of tags in the range of the receiver, to a point at which no further collisions of supervisory messages are encountered (or to a predetermined maximum limit time, for safety reasons). The probability decreases with increasing listen period, given a fixed number of tags; the listen time is increased with increasing number of tags with predetermined fixed probability.

Thus, in the Figure, receiver 22 has a listen period setting which is a function of the number of tags in its detection range, in this case two. Receiver 24 has a different (and longer) listen time setting due to the number of tags in its detection range, in this case five.

Control logic to establish the listen time of a receiver can be located in each receiver, or in control computer 30. For example, the receiver can count the number of tag IDs that it receives within a predetermined time as described earlier, and sends that number to the control computer with its receiver ID. The control computer can then determine in accordance with a predetermined formula how long the listen time should be, and sends a control message to the receiver to adjust its listen time. This can be done by each receiver on an ongoing basis, whereby the listen time of each receiver is dynamically adjusted.

Alternatively, the control logic can be contained in each receiver, and its listen time adjusted locally.

The control computer, if used, can download to each receiver a list of the tag IDs expected to be in its range, for comparison purposes. Further, if a tag is determined to have disappeared from the region of a particular receiver, it can send that information to the computer as an alarm, or as an indication of its disappearance. The computer can determine that the tag has moved to the region of another receiver, by tracking its ID.

If the control computer is used, and if a tag is determined to be in the detection range of more than one receiver, its continued presence can be determined by the lowest listen interval.

Figure 2:
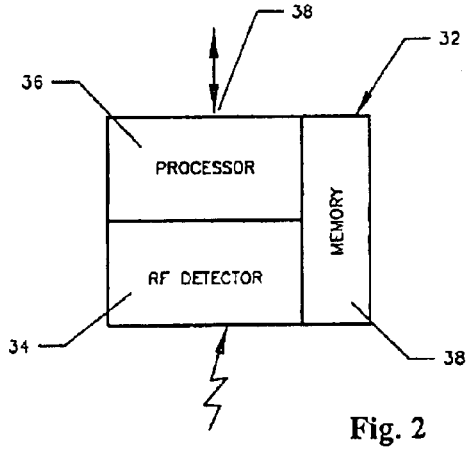
FIG. 2 is a block diagram of a receiver that can be used to implement the present invention.

FIG. 2 illustrates a receiver 32, which includes a radio frequency receiver 34 for detecting supervisory signals randomly transmitted by tags, a processor 36 for distinguishing tag IDs from the supervisory signals from signals passed to it by the receiver 34, and a memory 38 for storing both operation programs for the processor and a table of ID accessible by the processor, if stored as described in accordance with an embodiment described above. The processor can have an input/output port 38 for communicating with control computer 30.

In the above manner, the present invention can identify the presence of tags within the ranges of various receivers even in the presence of collisions, thus allowing the use of inexpensive, possibly throwaway tags. The present invention can thus be used in systems that were previously uneconomical.

The term "raising an alarm" in this specification should be construed to mean indicating the non-receipt of an ID that was expected to have been received.

It should be noted that while each of the receivers can be used in separate spaced regions, they need not be confined within buildings or grounds of a building. They can be dispersed within a city, or across country. For example, the tags can be hidden in automobiles, emitting very short, long time-spaced messages containing their unique IDs. Stolen cars can thereby be located. The location of such outfitted police or taxi cars can be located, for efficient dispatch to an address within the region. If carried by transport trucks, the general location of the trucks across country can be tracked. The receivers can be carried in low-orbit, limited range earth satellites. Indeed, for locating such satellites, each can carry a tag, for detection within the limited ranges of ground-based receivers. Tags carried by automobiles can be used as an initial locating device in a global positioning system (GPS).

A person understanding the above-described invention may now conceive of alternative designs, using the principles described herein. All such designs which fall within the scope of the claims appended hereto are considered to be part of the present invention.

We claim:

1. A method of detecting a variable number of objects within range of a receiver, comprising:

(a) transmitting from each object a supervisory message from time to time;

(b) detecting the supervisory message by the receiver over a detection interval;

(c) dynamically varying the detection interval based on a number of objects under supervision and the probability of collisions of the supervisory messages;

(d) increasing the detection interval to the extent that no collisions of any previously undetected supervisory message occurs; and (e) raising an alarm in the event a supervisory message of a previously detected object is not detected within the detection interval.

2. A method as defined in claim 1 including randomly transmitting the supervisory messages from various objects.

3. A method as defined in claim 2 including keeping track of the number of tags in a detection region of a receiver by determining an average number of supervisory messages over a predetermined time period.

4. A method as defined in claim 2 including keeping track of the number of tags in a detection region of a receiver by maintaining a table of unique Ids of respective objects from Ids transmitted In the supervisory messages.

5. A method as defined in claim 1 including controlling the receiver from a control computer, and determining the detection interval for such control by the control computer.

6. A method as defined in claim 1 including plural ones of said receivers each having an object detection region which overlaps the detection region of a neighboring receiver, and repeating steps (a), (b), (c) and (d) for each receiver.

7. A method as defined in claim 6 including controlling the receivers from a control computer, and determining various detection intervals of the respective receivers by the control computer.

8. A method as defined in claim 7 including raising an alarm in the event the supervisory message from an object detected by more than one receiver is not detected within a detection interval which is the shortest used by said more than one receiver.

9. A method as defined in claim 1 in which the objects are attachments to physical structures or living entities.

10. A method as defined in claim 1 in which the objects are located on or adjacent the surface of the earth and in which the receiver is located in an earth satellite.

11. A method as defined in claim 1 in which the objects are located in plural earth satellites, and in which the receiver is located on or adjacent the surface of the earth.

12. A method of detecting a variable number of objects within range of a receiver, comprising:

(a) transmitting from each object a supervisory message from time to time:, (b) detecting the supervisory message by the receiver over a detection interval;

(c) dynamically varying the detection interval based on a number of objects under supervision and the probability of collisions of the supervisory messages;

(d) Increasing the detection interval to the extent that no collisions of any previously undetected supervisory message occurs;

(e) providing plural ones of said receivers each having an object detection region which overlaps the detection region of a neighboring receiver, and repeating steps (a), (b), (c), and (d) for each receiver;

(f) controlling the receivers from a control computer, and determining various detection intervals of the respective receivers by the control computer; and (g) raising an alarm in the event the supervisory message from an object detected by more than one receiver is not detected within a detection interval which is the shortest used by said more than one receiver.

13. A method as recited in claim 1 wherein each object is capable of transmitting but not receiving.

14. A method as recited in claim 12 wherein each object is capable of transmitting but not receiving.

15. A method as recited in claim 12 including randomly transmitting the supervisory messages from various objects.

16. A method as recited in claim 15 including keeping track of the number of tags in a detection region of a receiver by determining an average number of supervisory messages over a predetermined time period.

17. A method as recited in claim 15 including keeping track of the number of tags in a detection region of a receiver by maintaining a table of unique Ids of respective objects from Ids transmitted in the supervisory messages.

18. A method as defined in claim 12 in which the objects are attachments to physical structures or living entities.

19. A method as defined in claim 12 in which the objects are located on or adjacent the surface of the earth and in which the receiver is located in an earth satellite.

20. A method as defined in claim 12 in which the objects are located in plural earth satellites, and in which the receiver is located on or adjacent the surface of the earth.

* * * * *